United States Patent [19]

Meetze, Jr.

[11] 4,063,664

[45] Dec. 20, 1977

[54] DEVICE FOR INDICATING WHEN AUTOMATIC, PERIODIC OPERATION HAS EMPTIED AN AEROSOL CONTAINER

[75] Inventor: Murray O'Neil Meetze, Jr., Columbia, S.C.

[73] Assignee: The Risdon Manufacturing Company, Naugatuck, Conn.

[21] Appl. No.: 722,690

[22] Filed: Sept. 13, 1976

[51] Int. Cl.[2] ..... B67D 5/28

[52] U.S. Cl. ..... 222/70

[58] Field of Search ..... 222/70, 76, 23, 39; 239/69, 70

[56] References Cited

U.S. PATENT DOCUMENTS 3,837,532 9/1974 Sahatjian et al. ..... 222/70

*Primary Examiner*—Stanley H. Tollberg

*Attorney, Agent, or Firm*—St. Onge, Mayers, Steward & Reens

[57] ABSTRACT

A device incorporated in an apparatus for automatically and periodically operating an aerosol container indicates when the container has been emptied and then stops operation of the container. The container operating apparatus includes a motor operatively linked to the container and a power supply for powering the motor. The stopping and indicating device comprises a timing circuit that includes a first time measuring network that produces motor actuating output pulses at a first periodic rate, each actuating pulse being of duration sufficient to cause the motor to operate the container. The timing circuit also includes a second time measuring network that produces non-actuating output pulses at a second periodic rate substantially greater than the first rate, each non-actuating pulse being of duration insufficient to cause the motor to operate the container. A switch selectively operates the motor through either the first or the second time measuring network and a sensor, which determines when the container has been emptied, actuates the switch to operate the motor through the second time measuring network.

14 Claims, 8 Drawing Figures

DEVICE FOR INDICATING WHEN AUTOMATIC, PERIODIC OPERATION HAS EMPTIED AN AEROSOL CONTAINER

BACKGROUND OF THE INVENTION

1. Field of the Invention

The present invention relates to an apparatus for automatically and periodically operating an aerosol container in discreet dispense cycles to discharge a metered quantity of the container's contents. More particularly, the invention relates to a device incorporated in this apparatus for stopping operation of the container and for indicating when it has been emptied.

Pressurized aerosol containers are widely used to dispense various consumer products such as room deodorizers, insecticides, germicides and the like. These containers typically include an internally mounted valve connected to an outwardly projecting valve stem which carries a fluid atomizing nozzle. Inward depression or tilting of the valve stem opens the valve to discharge contents of the container as a fine spray through the nozzle. The valve may be of the type that discharges contents of the container as long as it is held open, or may only discharge a metered quantity every time it is operated.

Non-pressurized containers which dispense consumer products are also available. These containers are typically equipped with a pump, of either of the "throttling" or "non-throttling" type, having a plunger which carries a nozzle. When the plunger is depressed, the container's contents are discharged as a fine spray. If the pump is of the "non-throttling" type, discharge only occurs after a predetermined pressure has been developed thereby. If the pump is of the "throttling" type, discharge occurs as soon and as long as it is operated.

The term "aerosol" is usually used to identify containers of the pressurized type described above and is not ordinarily applied to non-pressurized containers equipped with a pump. However, the apparatus and device of the present invention may be used equally well with either type container. Therefore, as used in this specification and the concluding claims, the term "aerosol" is intended to include both pressurized containers equipped with valves, non-pressurized containers equipped with pumps or any other container which includes a mechanism operable to discharge contents of the container by being depressed inwardly or by being tilted.

2. Description of the Prior Art

Products such as room deodorizers, insecticides and germicides, are most effective when dispensed periodically into the air and distributed uniformly in the area they are intended to treat. Therefore, various devices have been proposed which automatically and periodically operate aerosol containers of these products. One such device, disclosed in U.S. Pat. No. 3,739,944 (Rogerson), includes a DC motor coupled through a reduction gear train and lever to the nozzle and further, the valve of an aerosol container. A timing circuit, which connects the motor to a power supply, delivers periodic pulses of power which energize the motor to thereby operate the aerosol valve. The timing circuit includes a resistance-capacitance (RC) charging network having a discharge path through a unijunction. Accordingly, when the charge on the capacitor in the RC network exceeds the trigger level of the unijunction, an energizing pulse is delivered to the motor. However, when the capacitor is discharged to a minimum level the pulse terminates. Further, the time required to charge the capacitor determines the periodicity of operation of the container. The time required to discharge the capacitor is selected to be sufficient to operate the aerosol valve, when its inertia and mechanical resistance to operation are considered.

Other devices for automatically and periodically operating an aerosol container are disclosed in U.S. Pat. Nos. 3,779,425 (Werner); 3,726,437 (Siegel); 3,589,563 (Carragan et al.); 3,584,766 (Hart et al.); 3,187,949 (Mangel); and 3,018,056 (Montgomery). However, none of the patents reviewed above discloses apparatus for automatically stopping operation of the container when empty or for indicating when the container is empty.

SUMMARY OF THE INVENTION

The apparatus of the present invention automatically and periodically operates an aerosol container in discreet dispense cycles to discharge metered quantities of the container contents. Further, this apparatus includes a device which stops operation of the container when empty and also indicates when the container is empty. In one of its preferred embodiments, this device counts the number of discreet dispense cycles through which the container is operated and halts operation after a predetermined number of cycles calculated to be that which empties the container. In an alternative embodiment, the device directly senses when contents fail to be discharged to thereby determine that the container is empty.

In its preferred embodiments, the apparatus includes a motor operatively linked to the container and a power supply for powering the motor. The device for stopping operation and indicating when the container is emptied comprises a timing circuit that interconnects the power supply and the motor and includes a first time measuring network that produces motor actuating output pulses at a first periodic rate. Each of these pulses is of duration sufficient to cause the motor to operate the container. The timing circuit further includes a second time measuring network that produces non-actuating output pulses at a second periodic rate substantially greater than the first. Each of these pulses is of duration insufficient to cause the motor to operate the container. A switch selectively operates the motor through either the first or the second time measuring networks of the timing circuit. This switch is actuated by the empty can detector, which may be the mechanical counter or the discharge sensor, to operate the motor through the second time measuring network after the predetermined number of dispense cycles.

Thus, when the motor is operated through this second timing network on signal from either the counter or the sensor, it is pulsed so rapidly that it cannot overcome the inertia and mechanical resistance of the aerosol container valve and accordingly does not operate the valve.

The first time measuring network includes components having large capacitance for charging from a preselected minimum to a preselected maximum value in a time determinative of the first periodic rate and for discharging from the maximum to the minimum value to thereby generate an actuating output pulse. The second time measuring network includes components having small capacitance, substantially less than that of the components having large capacitance, for charging from the minimum to the maximum value in a time determinative of the second periodic rate and for discharging from the maximum to the minimum to thereby generate the non-actuating output pulses. The timing circuit also includes a trigger connected to both components having large and small capacitances to be actuated thereby. The components having large capacitance include a small and large capacitor connected in parallel. The switch is arranged to disconnect the large capacitor from the circuit leaving only the small capacitor which forms the component having small capacitance.

An indicator which provides, for example, a visual or aural signal, is connected in parallel with the motor to be energized at the same rate thereas. Therefore, when pulsed by the second time measuring network, the indicator gives rapid periodic signals which demonstrate that the container is empty and should be replaced.

Accordingly, it is an object of the present invention to provide an apparatus for automatically and periodically operating an aerosol container and incorporating a device in that indicates when the container is empty as well as for stopping operation thereof.

Other objects, aspects, and advantages of the present invention will be pointed out in, or will be understood from the following detailed description provided below in conjunction with the accompanying drawings.

DETAILED DESCRIPTION OF THE PREFERRED EMBODIMENTS

Figure 1:
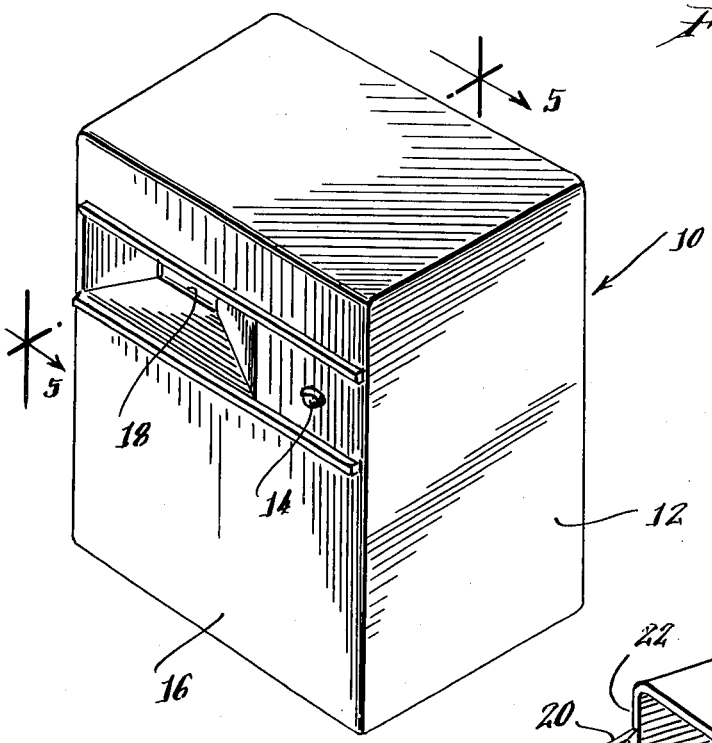
FIG. 1 is a perspective view of an apparatus for automatically and periodically operating an aerosol container in discreet dispense cycles to discharge metered quantities of the container's contents.

As shown in FIG. 1, the apparatus of the present invention, generally indicated at 10, for automatically and periodically operating an aerosol container comprises an exterior housing 12 which may be formed by injection molding a thermoplastic or by any other suitable process using an appropriate material. An indicating device, in the form of a light emitting diode (LED) 14, is mounted in the front face 16 of housing 12 and a discharge aperture 18 is positioned adjacent the LED. The operation of the LED 14 will be described in greater detail below.

Figure 2:
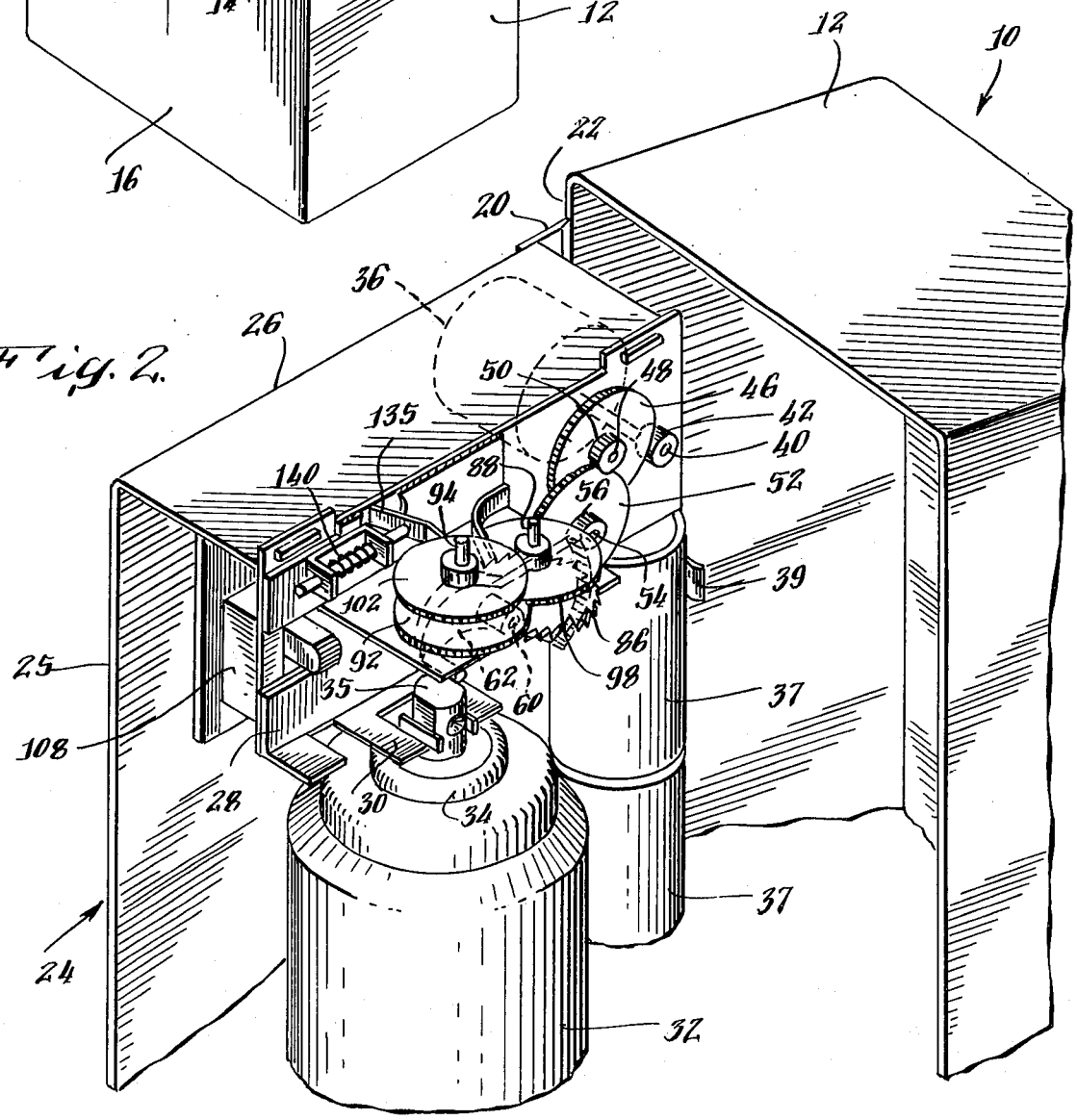
FIG. 2 is a second perspective view of this apparatus opened to show its internal components which include a mechanical counter for determining approximately when the container has been emptied.

Referring to FIG. 2, the rear of housing 12 is open to receive the internal components of the apparatus. For convenience, a flexible hinge 20 is formed with one side wall 22 of housing 12 and a main frame, generally indicated at 24, on which these components are mounted, is attached to the hinge 20 to swing outwardly from housing 12. Main frame 24, which may be made for example, from sheet metal, includes a back plate 25, a generally horizontal top plate 26 from which an intermediate bracket 28 is suspended, and a similar, generally horizontal container supporting platform (not shown). Spaced from the platform is a container positioning collar 30. A conventional container 32 having such a ferrule 34 is supported in operative relation to the remaining components of the apparatus 10 when installed between the platform and collar and the nozzle 35 which is depressed or tilted to operate the aerosol valve (not shown) mounted internally of the container, is directed to discharge product forwardly of the main frame. Further, when the hinged main frame 24 is closed into housing 12, product discharge is directed through aperture 18.

As noted above, this apparatus may be adapted with equal advantage to operate non-pressurized containers equipped with, for example, throttling or non-throttling pumps to discharge the container's contents as a spray. Only the main frame, container support platform, and collar described above need be modified to accommodate such a container.

Figure 3:
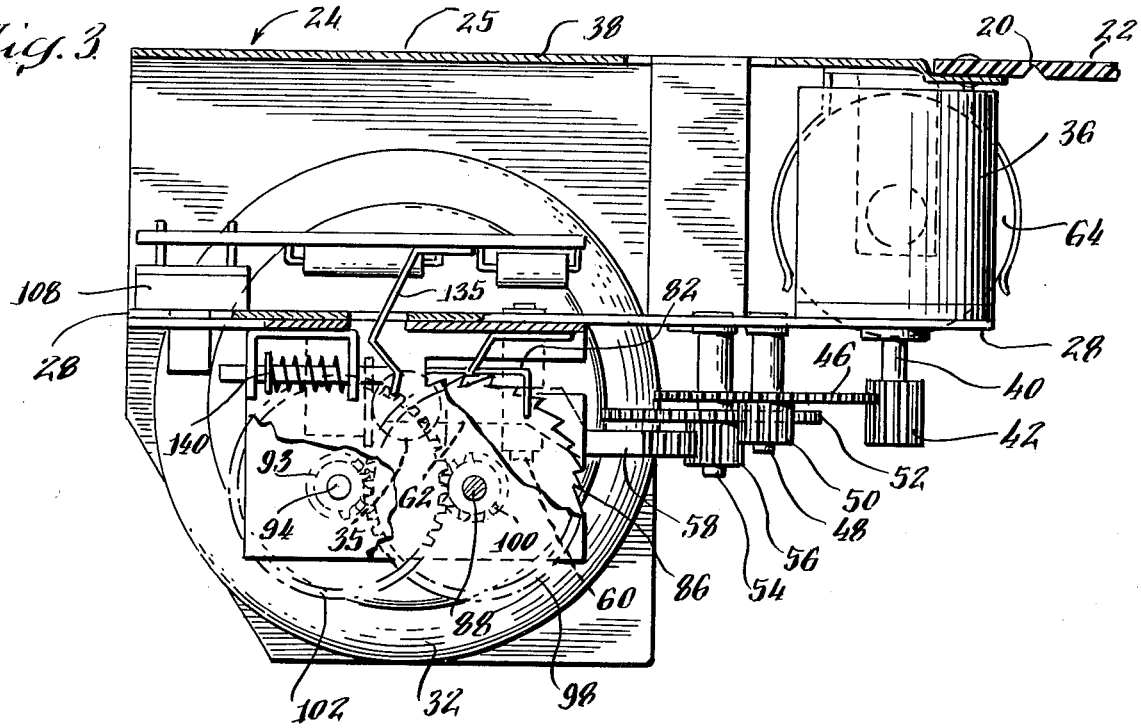
FIG. 3 is a top plan view of the internal components of this apparatus.
Figure 4:
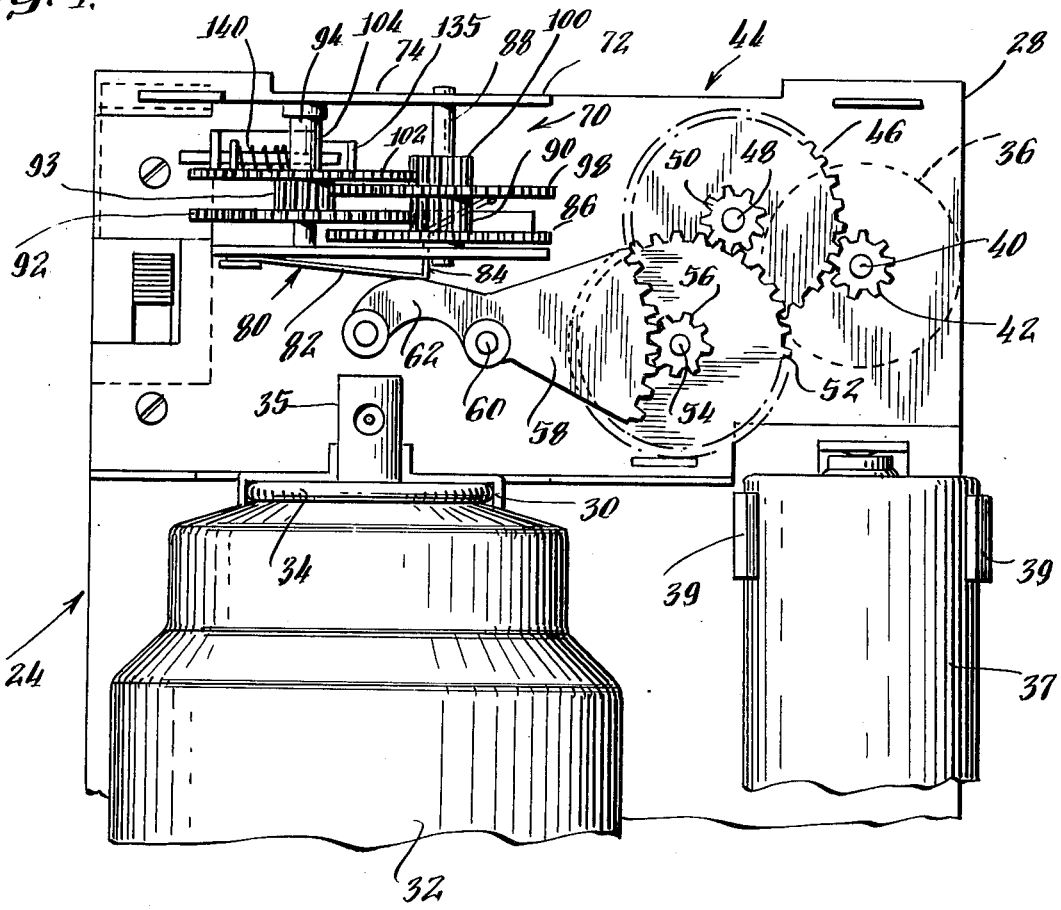
FIG. 4 is a partial front elevational view of the apparatus showing the mechanism for actuating the aerosol container in detail.
Figure 5:
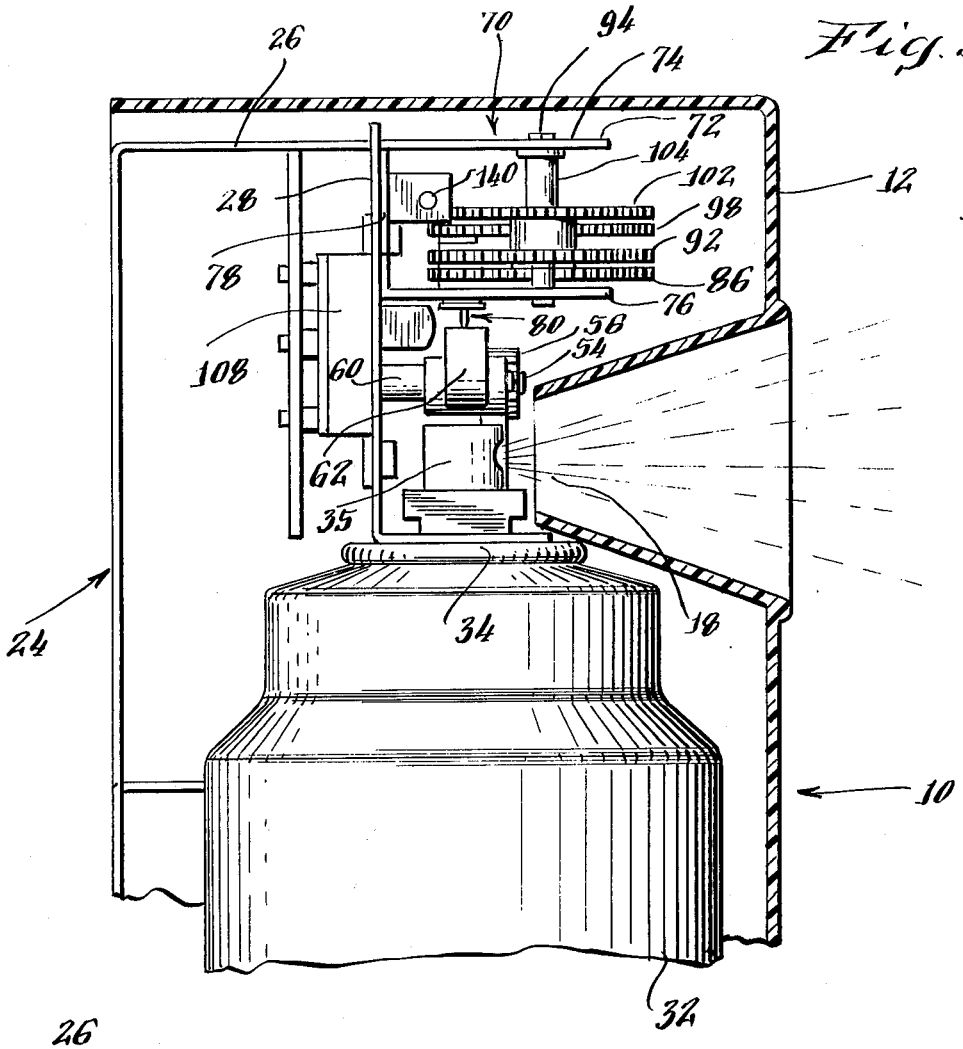
FIG. 5 is a side elevational view of this apparatus shown partly in cross-section through the apparatus housing.

As shown in FIG. 2 and in greater detail in FIGS. 3 and 4, the apparatus 10 further includes a small DC motor 36, mounted between the back plate 25 and the intermediate bracket 28 of main frame 24, which is powered by a pair of D-sized flashlight batteries 37 which are mounted on a bracket 39 punched from back plate 25. Motor 36 has a drive shaft 40 which extends forwardly of intermediate bracket 28 and carries a pinion 42 for rotation therewith. Pinion 42 is positioned to drive a reduction gear train generally indicated at 44 and similar to that disclosed in U.S. Pat. No. 3,739,944 (Rogerson). Gear train 44 comprises a first driven gear 46 mounted for rotation on a shaft 48 projecting forwardly from intermediate bracket 28 and coupled to pinion 42. A first driven pinion 50 is mounted to rotate with driven gear 46 and meshes with a second driven gear 52 mounted for rotation on a second shaft 54 projecting forwardly from intermediate bracket 28. Second driven gear 52 also carries a driven pinion 56 which ultimately meshes with a sector gear 58 mounted for pivoted movement on a third shaft 60. A lever 62 projects laterally from shaft 60, is integrally formed with sector gear 58 and is positioned in operative relation to the valve actuating nozzle 35 of container 32. The ratio of the reduction gear train 44 is chosen to provide an appropriate mechanical advantage for motor 36 to actuate the aerosol valve in container 32 when periodically energized in a manner described below.

The apparatus 10 of the present invention is also equipped with a device for stopping operation of and for indicating when the container is empty.

In one embodiment, this device makes use of the fact that aerosol containers are ordinarily filled and distributed with known amounts of product. Aerosol valves can similarly be made to dispense quantities of the liquid product in known or metered amounts when operated. Therefore, if the number of valve operations which will empty the container is known, an indication of when the container is emptied may be obtained by counting the number of operations.

Therefore, the first embodiment of the present invention includes a counting mechanism, generally indicated at 70, shown in FIGS. 2 through 5 but seen best in FIG. 4. This counting mechanism includes a C-shaped housing 72 (FIG. 5) having upper and lower horizontal plates 74 and 76 projecting forwardly from a rear plate 78 which is attached to intermediate bracket 28 by suitable means. A ratchet spring 80 is attached to the lower plate 76 and has a generally horizontal portion 82 positioned to be contacted and deflected by the lever 62. A vertical portion of spring 84 projects upwardly through an aperture in the lower plate into operative relation with a ratchet gear 86 which is mounted for rotation on a shaft 88 spanning the distance between upper and lower plates 74 and 76. Each time spring 80 is deflected by movement of lever 62 the ratchet gear 86 is rotated through an angle defined by one tooth.

A pinion 90 is formed with ratchet gear 86 to rotate therewith and engages a driven spur 92 mounted on a second shaft 94. Two more spur and pinion combinations 98–100 and 102–104 complete the counter mechanism gear train spur 98 being engaged by a pinion 93 formed with first spur 92. The gear ratio of this train is selected to produce one complete revolution of the last spur and pinion combination 102–104 when the container has been operated the predetermined number of times required to empty it. Therefore, the counter mechanism can be used to signal other portions of the apparatus that the container is empty and to stop further container operation.

Figure 6:
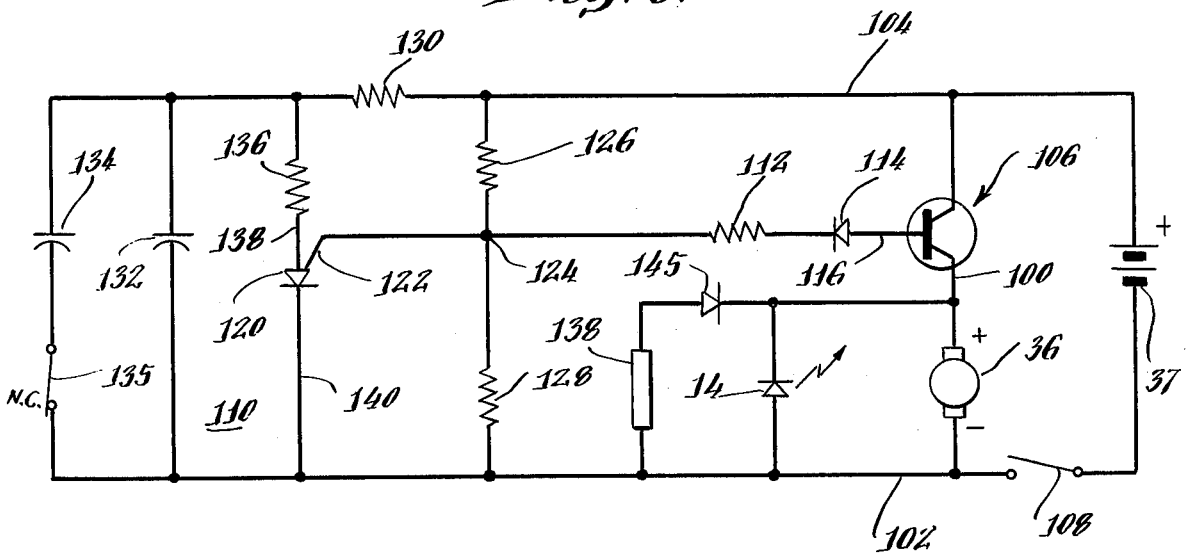
FIG. 6 is a diagram of the electrical circuit for controlling actuation of the aerosol container and of the device for stopping container operation and for indicating when the container has been emptied.

In this preferred embodiment, the counter mechanism is utilized to signal a timing control circuit, shown in FIG. 6, which is arranged to produce an energizing pulse on line 100 from the batteries 37 to motor 36. The batteries produce a three volt potential across power leads 102 and 104. Lead 104 is connected through an output transistor switch 106 to the positive input of motor 36 and lead 102 is connected through an on-off switch 108 (also shown in FIGS. 2 through 5) to the negative input of the motor. The transistor output which is controlled by a unijunction timer network 110 connected through a current limiting resistor 112 and a diode 114 to the output transistor switch base 116.

The unijunction timer network 110 comprises a programmable unijunction 120, the triggering level of which is a function of the bias potential developed at its gate 122 by the voltage at a junction 124 between series connecting resistors 126 and 128. A charging RC network also part of the unijunction network 110 comprises resistor 130 and two capacitors 132 and 134. The capacitors are connected in parallel by a normally closed switch 135. The operation of the respective capacitors will be described in greater detail below.

A current limiting, low value resistor 136 connects the parallel connected capacitors to the anode 138 of unijunction 120. The values of the resistors 126, 128 and 130 and the total capacitance connected in the RC network determine the rate at which the unijunction is triggered.

During initial operation of the timing network 110, the bias voltage developed at junction 124 is insufficient to overcome the base to emitter voltage of output transistor switch 106 plus the forward voltage of diode 116. Therefore, the output transistor switch does not conduct and the motor 36 is not energized. However, as the capacitors connected in the RC network charge through resistor 130, the voltage at unijunction anode 138 reaches the unijunction triggering level at which time the impedance between anode 138 and cathode 140 drops to a low value. Thus, the capacitors discharge through resistor 136. Simultaneously, impedance between gate 122 and cathode 140 drops to a low level so that the voltage at junction 124 also drops to a level sufficiently low to establish a forward bias on the base-to-emitter junction of output transistor switch 106. This switch then conducts.

The motor 36 begins to drive the gear train 44 as soon as transistor switch 106 conducts and continues to do so until the capacitance connected in the RC network is discharged. Moreover, the capacitors have values so that the discharge time is sufficient to overcome the inertia of the mechanical components of the apparatus as well as the closing spring force and inertia of the aerosol valve so that a metered quantity of the container's contents is discharged.

After the capacitance has been discharged to a minimum voltage, which is a function of the characteristics of unijunction 120, the unijunction anode-to-cathode and gate-to-cathode junctions present high impedances. The bias voltage at junction 124 is then reestablished to bias the base-to-emitter voltage of output transistor switch 106 at a non-conducting level.

The periodic rate at which the motor receives energizing pulses and the duration of each pulse is determined by the total capacitance connected to unijunction 120. In accordance with the present invention, the total capacitance of capacitors 132 and 134, namely the sum of the capacitance values of each, is such that they charge in 12 to 18 minutes. Further, the time required for their discharge is approximately 0.5 seconds which is sufficient to produce a power pulse to motor 36 in order to overcome the inertia of the mechanical components of the apparatus as well as the closing spring force and inertia of the aerosol valve so that a metered quantity of the container's contents are discharged.

However, capacitor 132 is substantially smaller than capacitor 134. Specifically, the capacitance of capacitor 132 alone is such that it charges from the minimum to maximum unijunction actuating voltage not in 12 to 18 minutes but in 0.5 seconds. Capacitor 132 also discharges from maximum to minimum voltage in even shorter time, on the order of 0.25 milliseconds. Thus, the periodic rate at which the motor is pulsed when only capacitor 132 is connected in the RC charging network is approximately one-half second. Moreover, the discharge time is insufficient for the motor to overcome the inertia of the mechanical components of the system. Therefore, the container is not operated.

Operation of switch 135 which determines the capacitance which is connected in the RC charging network is controlled by the counting mechanism 70. That is, the last spur-pinion combination 102 - 104 is provided with a lever positioned to open switch 135 every time it completes one revolution. Accordingly, when the apparatus is in its normal operating condition, the container is actuated to discharge a quantity of its contents every 12 to 18 minutes. Simultaneously, the counter is actuated to record each actuation. When the container has been actuated a number of times calculated to empty it, the counter trips switch 135 after which the motor 36 is pulsed so rapidly and for such short time that the container cannot be actuated.

LED 14 is connected in parallel with motor 36 to flash each time the motor receives an energizing pulse.

Therefore, when the motor is rapidly pulsed under the influence of small capacitor 132, LED 14 flashes rapidly as a visual indication that the container is empty.

So that the indicating device does not add unnecessary current drain to the battery, the LED 14 is reverse biased across the motor. When connected with this polarity, the LED 14 draws no current from the battery 37. Instead, the LED 14 is energized by the inductive voltage generated when the motor 36 turns off.

Alternatively or supplimentary to the LED, an aural device 138 such as a buzzer or loudspeaker may be connected in parallel with motor 36 to give a further indication that the container has been emptied. A inverse biased diode 145 allows the aural device 138 to draw current only from the inductive spike generated by the motor 36 turning off. The diode 145 further prevents current flow to the aural device 138 from the battery 37.

As shown in FIGS. 2 through 4, a reset button 140 is provided to reset switch 135 after the empty container is replaced with a full one.

Figure 7:
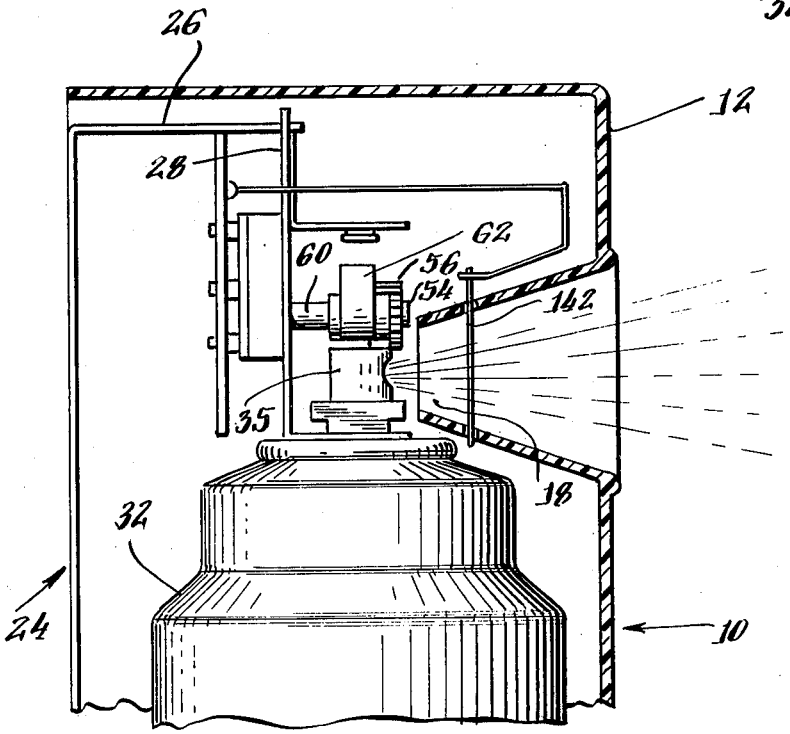
FIG. 7 is a side elevational view similar to FIG. 6, showing an apparatus in which a container discharge sensor has been substituted for the mechanism counter.

The apparatus 10 may incorporate an empty container sensor, instead of the counting mechanism, in the form of a small thermocouple 142 positioned so that discharge from the container passes over it (FIG. 7). Each time the container is operated, impingement and subsequent rapid evaporation of the discharge on the thermocouple causes it to cool and thus generate an output signal. However, when the container is emptied and no discharge occurs, the thermocouple is not cooled and does not generate an output signal.

Figure 8:
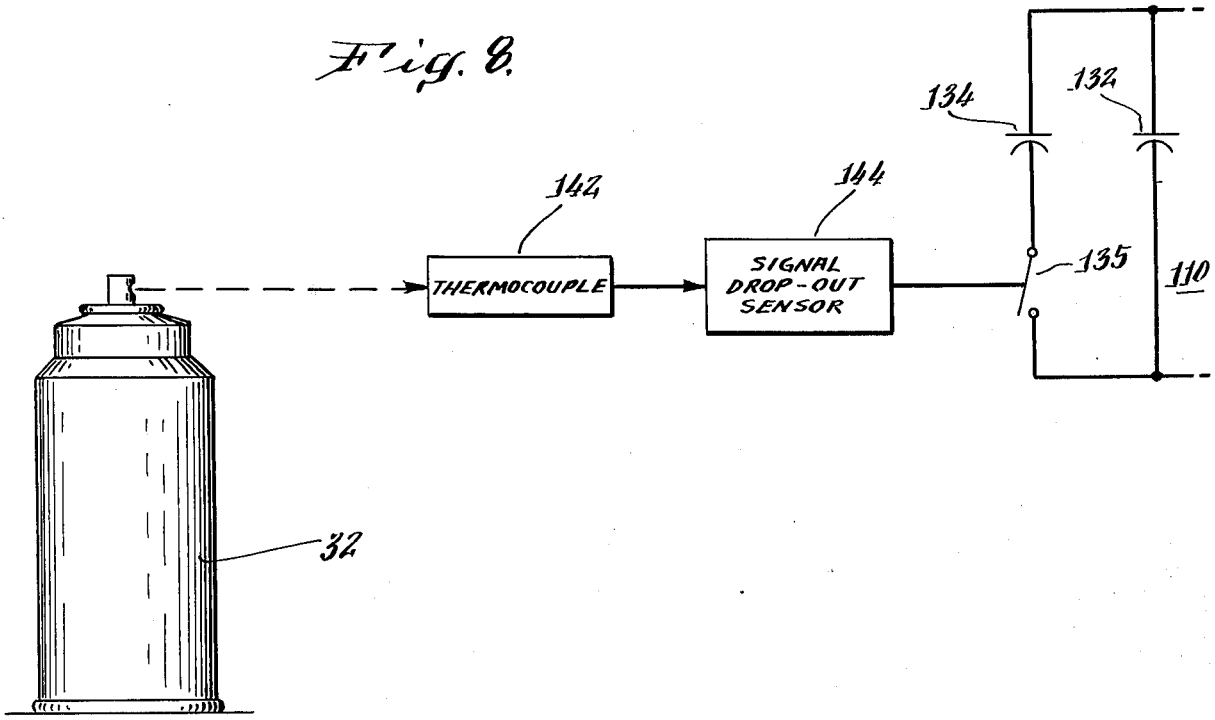
FIG. 8 is a partial diagram of the electrical circuit used in conjunction with the discharge sensor.

The thermocouple is connected to a signal drop-out sensor 144 (FIG. 8) which operates switch 135 when the thermocouple output signal ceases. The remainder of the circuit for control and actuation of the motor and either or both a visual or aural indicator then functions as described above.

Although specific embodiments of the present invention have been described above in detail, it is to be understood that this is for purposes of illustration. Modifications may be made to the apparatus for automatically and periodically actuating aerosol containers and to the device for stopping actuation and indicating when the container is empty by those skilled in the art in order to adapt them to particular applications.

What is claimed is:

1. In an apparatus for automatically and periodically operating an aerosol container in discreet dispense cycles to discharge a metered quantity of the contents thereof, the apparatus including a motor operatively linked to the container and a power supply for powering the motor; a device for stopping automatic, periodic operation of the container when it has been emptied, said device comprising:

A. a timing circuit interconnecting the power supply and the motor and including:

1. first time measuring means for producing motor actuating output pulses at a first periodic rate, each actuating output pulse being of duration sufficient to cause the motor to operate the container, and
2. second time measuring means for producing non-actuating output pulses at a second periodic rate substantially greater than the first rate, each non-actuating pulse being of duration insufficient to cause the motor to operate the container, B. switch means for selectively operating the motor through said first and second time measuring means; and C. sensing means for determining when the container has been emptied and then for actuating said switch means to operate the motor through said second time measuring means.

2. The device for stopping automatic and periodic operation of an aerosol container when it has been emptied as claimed in claim 1 wherein said first time measuring means comprises:

large capacitor means for charging from a preselected minimum to a preselected maximum value in a time determinative of the first periodic rate and for discharging from the maximum to the minimum value thereby generating an output pulse, and wherein said timing circuit further comprises:

a trigger, connected to said large capacitor means through said switch means, responsive to output pulses to operatively connect the power supply to the motor when said large capacitor means is charged to maximum value and to operatively disconnect the power supply from the motor means when said large capacitor is discharged to the minimum value.

3. The device for stopping automatic and periodic operation of an aerosol container when it has been emptied as claimed in claim 2 wherein said second time measuring means comprises:

small capacitor means, having capacitance substantially smaller than said large capacitor means, for charging from the minimum to the maximum value in a time determinative of the second periodic rate and for discharging from the maximum to the minimum value thereby generating an output pulse.

4. The device for stopping automatic and periodic operation of an aerosol container after it has been emptied as claimed in claim 3 wherein said large capacitor means comprises:

a large capacitor, and a small capacitor connected in parallel with said large capacitor to said trigger.

5. The device for stopping automatic and period operation of an aerosol container when it has been emptied as claimed in claim 4 wherein said small capacitor means comprises said small capacitor and wherein said switch means comprises a switch adapted to disconnect said large capacitor from parallel connection with said small capacitor to said trigger.

6. The device for stopping automatic and periodic operation of an aerosol container when it has been emptied as claimed in claim 1 further comprising:

means for indicating when operation of the container has been stopped.

7. The device for stopping automatic and periodic operation of an aerosol container when it has been emptied as claimed in claim 6 wherein said indicating means comprises:

an indicating light interconnected to said power supply by said timing circuit to visibly flash at the first periodic rate before operation of the container has been stopped by said device and to visibly flash at the second substantially greater periodic rate after operation of the container has been stopped by the device.

8. The device for stopping automatic and periodic operation of an aerosol container when it has been emptied as claimed in claim 6 wherein said indicating means comprises:

an aural indicating device, interconnected to said power supply by said timing circuit to generate a sound pulsating at the first periodic rate before operation of the container has been stopped by said device and to generate a sound pulsating at the second substantially greater periodic rate after operation of the container has been stopped by the device.

9. In an apparatus for automatically and periodically operating an aerosol container in discreet dispense cycles to discharge a metered quantity of the contents thereof, the apparatus including a motor operatively linked to the container and a power supply for powering the motor; a device for stopping automatic, periodic operation of the container when it has been emptied, after a predetermined number of dispense cycles, said device comprising:

A. a timing circuit interconnecting the power supply and the motor and including:

1. first time measuring means for producing motor actuating output pulses at a first periodic rate, each actuating output pulse being of duration sufficient to cause the motor to operate the container, and
2. second time measuring means for producing non-actuating output pulses at a second periodic rate substantially greater than the first rate, each non-actuating output pulse being of duration insufficient to cause the motor to operate the container.

B. switch means for selectively operating the motor through said first and second time measuring means, and C. counter means for determining when the container has been emptied by counting each operation of the container for the predetermined number of dispense cycles, and then for actuating said switch means to operate the motor through said second time measuring means.

10. The device for stopping automatic and periodic operation of an aerosol container when it has been emptied after a predetermined number of cycles as claimed in claim 9 wherein said counter means comprises:

1. a ratchet spring mounted in operative relation to the aerosol container to be deflected each time the container is operated,
2. a ratchet gear mounted to be rotated each time said ratchet spring is deflected to thereby count each container operation; and
3. a switch actuator associated with said ratchet gear to actuate said switch means after the container has been operated for the predetermined number of cycles.

11. The device for stopping automatic and periodic operation of an aerosol container when it has been emptied after a predetermined number of cycles as claimed in claim 10 wherein said counter means further comprises:

a reduction gear train interconnecting said ratchet gear and said switch actuator having a reduction gear ratio to operate said switch actuator once every predetermined number of cycles.

12. The device for stopping automatic and periodic operation of an aerosol container when it has been emptied after a predetermined number of cycles as claimed in claim 9 comprising:

reset means for resetting said device to repeatedly permit the apparatus to operate the container for the predetermined number of cycles.

13. In an apparatus for automatically and periodically operating an aerosol container in discreet dispense cycles to discharge a metered quantity of the contents thereof, the apparatus including a motor operatively linked to the container and a power supply for powering the motor; a device for stopping automatic, periodic operation of the container when it has been emptied, said device comprising:

A. a timing circuit interconnecting the power supply and motor and including, 1. first time measuring means for producing motor actuating output pulses at a first periodic rate, each actuating output pulse being of duration sufficient to cause the motor to operate the container, and
2. second time measuring means for producing non-actuating output pulses at a second periodic rate substantially greater than the first rate, each non-actuating pulse being of duration insufficient to cause the motor to operate the container, B. switch means for selectively operating the motor through said first and second time measuring means; and C. spray sensing means for determining when contents fail to be discharged during operation of the container and then for actuating said switch means to operate the motor through said second time measuring means.

14. The device for stopping automatic and periodic operation of an aerosol container when it has been emptied after a predetermined number of cycles as claimed in claim 13 wherein said spray sensing means comprises a thermocouple located to be impinged by spray discharge from the container.

* * * * *